US008496242B2

(12) United States Patent
Suttie

(10) Patent No.: US 8,496,242 B2
(45) Date of Patent: Jul. 30, 2013

(54) MEDIA CASSETTE

(75) Inventor: Robert Suttie, Fife (GB)

(73) Assignee: NCR Corporation, Duluth, GA (US)

( * ) Notice: Subject to any disclaimer, the term of this patent is extended or adjusted under 35 U.S.C. 154(b) by 259 days.

(21) Appl. No.: 12/955,333

(22) Filed: Nov. 29, 2010

(65) Prior Publication Data

US 2012/0132665 A1 May 31, 2012

(51) Int. Cl.
*B65H 1/00* (2006.01)

(52) U.S. Cl.
USPC ..... 271/161; 271/23; 271/165

(58) Field of Classification Search
USPC ..... 271/160, 161, 165, 167, 131, 21, 271/22, 23, 35, 188
See application file for complete search history.

(56) References Cited

U.S. PATENT DOCUMENTS

| | | | | |
|---|---|---|---|---|
| 2,991,075 | A * | 7/1961 | Wheeler et al. | 271/161 |
| 3,421,754 | A * | 1/1969 | Lozeau et al. | 271/161 |
| 3,933,350 | A * | 1/1976 | Mignano | 271/10.09 |
| 4,372,549 | A * | 2/1983 | Stiernspetz | 271/23 |
| 5,011,124 | A * | 4/1991 | Sardano et al. | 271/35 |
| 5,143,366 | A * | 9/1992 | Svyatsky | 271/122 |
| 6,322,066 | B1 * | 11/2001 | Rong | 271/119 |
| 7,934,719 | B2 * | 5/2011 | Tratar | 271/35 |
| 2010/0117294 | A1 * | 5/2010 | Maekawa et al. | 271/265.01 |
| 2011/0175278 | A1 * | 7/2011 | Fujikura et al. | 271/90 |

FOREIGN PATENT DOCUMENTS

WO WO 2008096428 A1 * 8/2008

* cited by examiner

*Primary Examiner* — Stefanos Karmis
*Assistant Examiner* — Ernesto Suarez
(74) *Attorney, Agent, or Firm* — Michael Chan

(57) ABSTRACT

A media cassette comprises: a base on which a stack of media items may be placed, a pusher plate biased towards the base and a plurality of drive rollers located beneath the profiled surface and partially protruding through apertures defined in the profiled surface. The base includes a profiled surface extending from a central low region disposed along an axis of the base to higher regions on opposing sides of the central low region. The pusher plate is operable to urge a stack of media items onto the profiled surface. The plurality of drive rollers are operable to drive a media item in contact with the profiled surface out of the media cassette.

19 Claims, 6 Drawing Sheets

MEDIA CASSETTE

FIELD OF INVENTION

The present invention relates to improvements in or relating to a media cassette.

BACKGROUND OF INVENTION

A well-known type of media cassette is a currency cassette. A currency cassette is used for storing a neat array of banknotes, and can be inserted into a currency dispenser. A currency dispenser withdraws banknotes, one at a time, from a currency cassette to fulfill a customer transaction.

It is desirable to be able to dispense reliably all conditions of banknotes, from new, crisp banknotes to old, limp banknotes. It is also desirable to be able to provide a low-cost currency dispenser that is able to do this.

SUMMARY OF INVENTION

Accordingly, the invention generally provides methods, systems, and apparatus for a media cassette comprising a profiled base for imparting a profile to a media item to be dispensed.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media cassette comprising:

a base on which a stack of media items may be placed, the base including a profiled surface extending from a central low region disposed along an axis of the base to higher regions on opposing sides of the central low region;

a pusher plate biased towards the base and operable to urge a stack of media items onto the profiled surface; and a plurality of drive rollers located beneath the profiled surface and partially protruding through apertures defined in the profiled surface, the plurality of drive rollers being operable to drive a media item in contact with the profiled surface out of the media cassette.

The profiled surface may comprise a first surface extending from the central low region to one of the higher regions, and a second surface extending from the central low region (on the opposite side of the axis of the base to the first surface) to another of the higher regions.

Alternatively, the profiled surface may comprise a curved surface. The curved surface may extend from a first high region, down to the central low region, and then back up to a second high region opposite the first high region.

The pusher plate may include an urging surface defining a profile corresponding to the shape of the profiled surface, thereby urging media items into the shape of the profiled surface.

The pusher plate may be biased towards the base by a resilient member, such as a spring. Alternatively, or additionally, the pusher plate may include a weight, and may be biased towards the base by the force of gravity acting on the weight. The weight may be incorporated into the pusher plate.

The plurality of drive rollers may each define a frusto-conical outer surface.

The plurality of drive rollers may be mounted on an axle located beneath the profiled surface and transverse to the axis of the base. The plurality of drive rollers may be mounted on two axles, each axle located beneath the profiled surface and each axle being disposed transverse to the axis of the base.

Each axle may include a pair of drive rollers on each side of the axis of the base.

A smaller diameter of each frusto-conical outer surface may be located nearer the axis of the base than a larger diameter of that frusto-conical outer surface.

The media cassette may further comprise a media withdrawing mechanism.

The media withdrawing mechanism may include a feed roller for withdrawing a media item from the base of the cassette.

The media withdrawing mechanism may further include a retard block having a profiled lower edge corresponding to the shape of the profiled surface and maintained in close proximity to the feed roller.

The retard block may be maintained in close proximity to the feed roller using adjustable static fixtures (such as screws, bolts, or the like). Alternatively, the retard block may be maintained in close proximity to the feed roller by a resilient member, such as a coil spring, a leaf spring, or the like.

Alternatively, the media withdrawing mechanism may further include a retard roller (instead of a retard block). The retard roller may comprise an undulating outer surface, with the radially furthest out portions of the undulating surface conforming to the shape of the profiled surface. The feed roller may also comprise an undulating outer surface (alternating large and small radial dimensions), complementary to, and aligned with, the undulating outer surface of the retard roller so that radially large portions of the retard roller are aligned with radially small portions of the feed roller, and vice versa, so that portions of the retard roller overlap portions of the feed roller when no media item is present.

One of the axles (or the axle, where only one is used) located beneath the profiled surface and transverse to the axis of the base may comprise a drive axle. Some of the drive rollers may be mounted on the drive axle and others of the drive rollers may be mounted on an auxiliary axle parallel to the drive axle.

The drive axle may include a power gear accessible from outside the media cassette. The power gear may be rotated by a corresponding gear located in a media dispenser. The power gear may also rotate the auxiliary axle either directly or via the drive axle.

The media cassette may define an exit port in the vicinity of the feed roller through which media items may be dispensed.

The media items may comprise banknotes, stamps, vouchers, coupons, tickets, receipts, or the like.

According to a second aspect there is provided a media dispenser including the media cassette according to the first aspect.

The media dispenser may include a transfer gear for engaging with the power gear in the media cassette. The transfer gear may be coupled to a dispenser chassis by a resilient member, such as a spring. Providing a resilient coupling for the transfer gear facilitates intermeshing between the transfer gear and the power gear when the media cassette is inserted into the media dispenser.

The media dispenser may comprise a plurality of cassette bays, each cassette bay being operable to receive a media cassette.

Each cassette bay may include a power gear.

According to a third aspect there is provided a self-service terminal including the media dispenser according to the second aspect.

The self-service terminal may be an automated teller machine (ATM), an information kiosk, a financial services centre, a bill payment kiosk, a lottery kiosk, a postal services machine, a check-in and/or check-out terminal such as those used in the retail, hotel, car rental, gaming, healthcare, and airline industries, and the like.

According to a fourth aspect there is provided a method of dispensing a media item from a media cassette, the method comprising:

deforming the media item within the media cassette into a profiled, non-flat, shape; and urging the deformed media item out of the media cassette using rollers having a profiled outer surface matching the profiled shape of the deformed media item.

According to a fifth aspect there is provided a media cassette comprising a base defining a profiled surface on which a stack of media items may be placed prior to dispensing.

The profiled surface may have a central region that is higher than surrounding regions, lower than surrounding regions, or higher than some surrounding regions but lower than other surrounding regions.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

Figure 1:
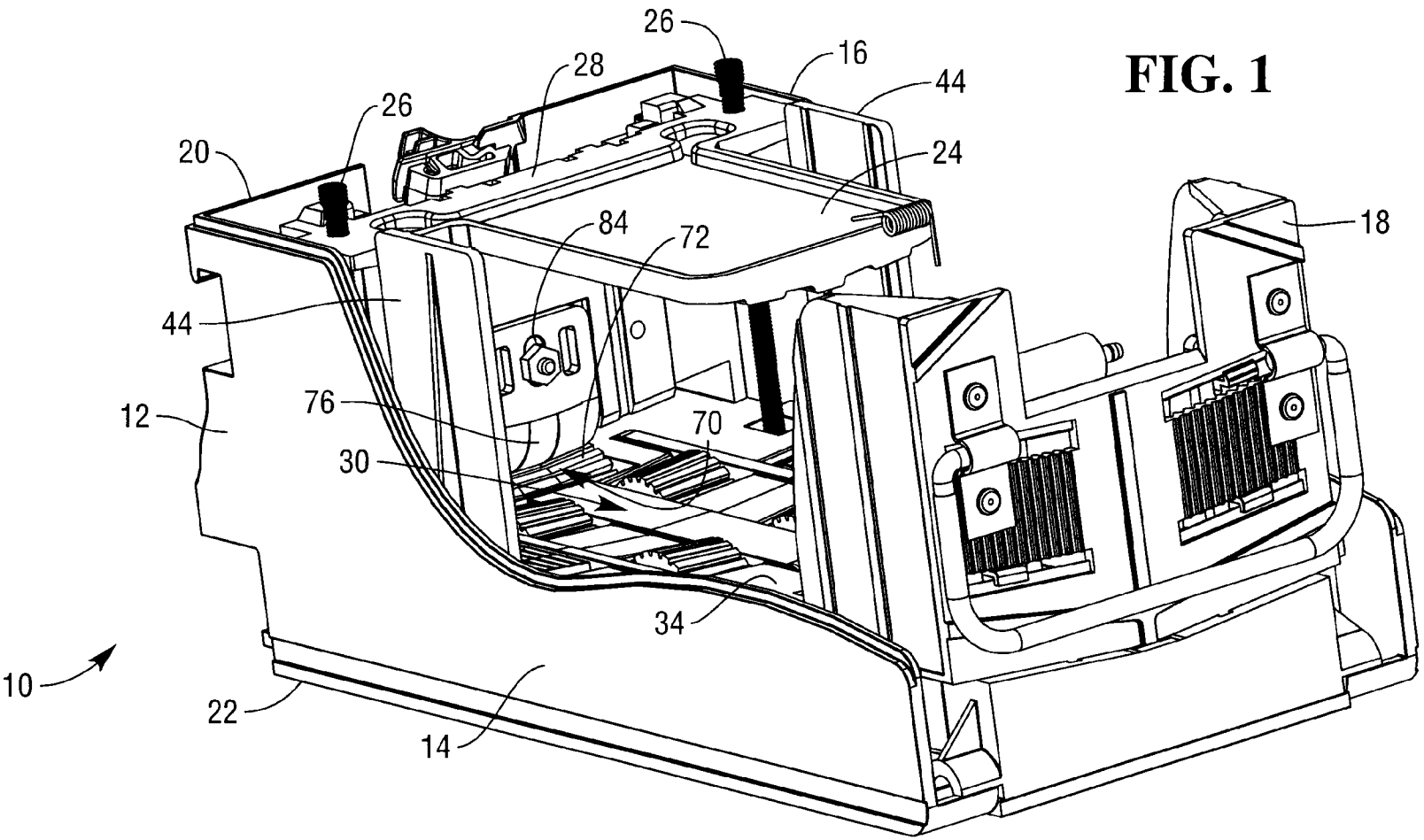
FIG. 1 is a cut-away perspective view of a media cassette according to one embodiment of the present invention.

It should be appreciated that some of the drawings provided are based on computer renderings from which actual physical embodiments can be produced. As such, some of these drawings contain intricate details that are not essential for an understanding of these embodiments but will convey useful information to one of skill in the art. Therefore, not all parts shown in the drawings will be referenced specifically. Furthermore, to aid clarity and to avoid numerous leader lines from cluttering the drawings, not all reference numerals will be shown in all of the drawings. In addition, some of the features are removed from some views to further aid clarity.

DETAILED DESCRIPTION

Figure 2:
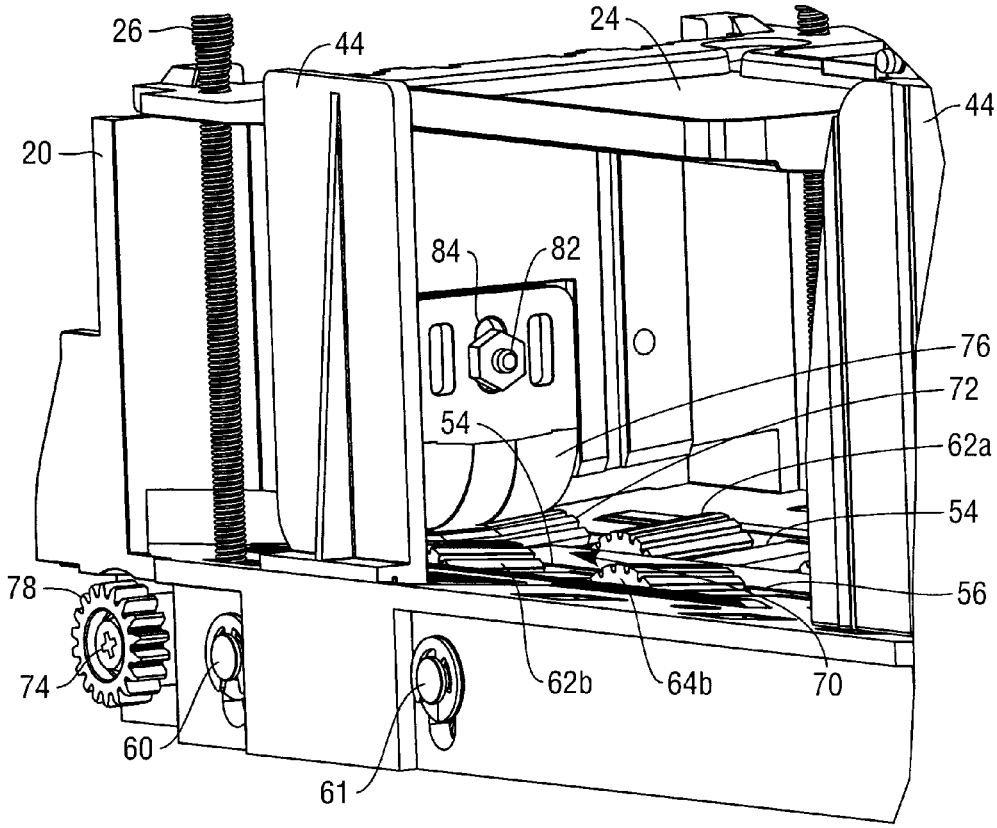
FIG. 2 is a cut-away perspective view similar to FIG. 1, but from a slightly different angle.

Reference is first made to FIGS. 1 and 2, which are cut-away perspective views of a media cassette 10 according to one embodiment of the present invention. The media cassette 10 is in the form of a currency cassette 10 that stores banknotes so that they can be removed short-edge first.

The currency cassette 10 comprises a housing 12 defining opposing long edge sidewalls 14,16, short edge sidewalls 18,20 extending between the long edge sidewalls 14,16, and a floor 22 coupled to the long edge sidewalls 14,16 and the short edge sidewalls 18,20.

The first short edge sidewall 18 is referred to as a handle end sidewall; the second short edge sidewall 20 is referred to as a pick end sidewall.

The currency cassette 10 also comprises a pusher plate 24 urged downwards by a pair of springs 26 coupled between the pusher plate 24 and the floor 22.

The currency cassette 10 also includes an internal block mount wall 28 coupled to the long edge sidewalls 14,16 near the pick end sidewall 20.

Figure 3:
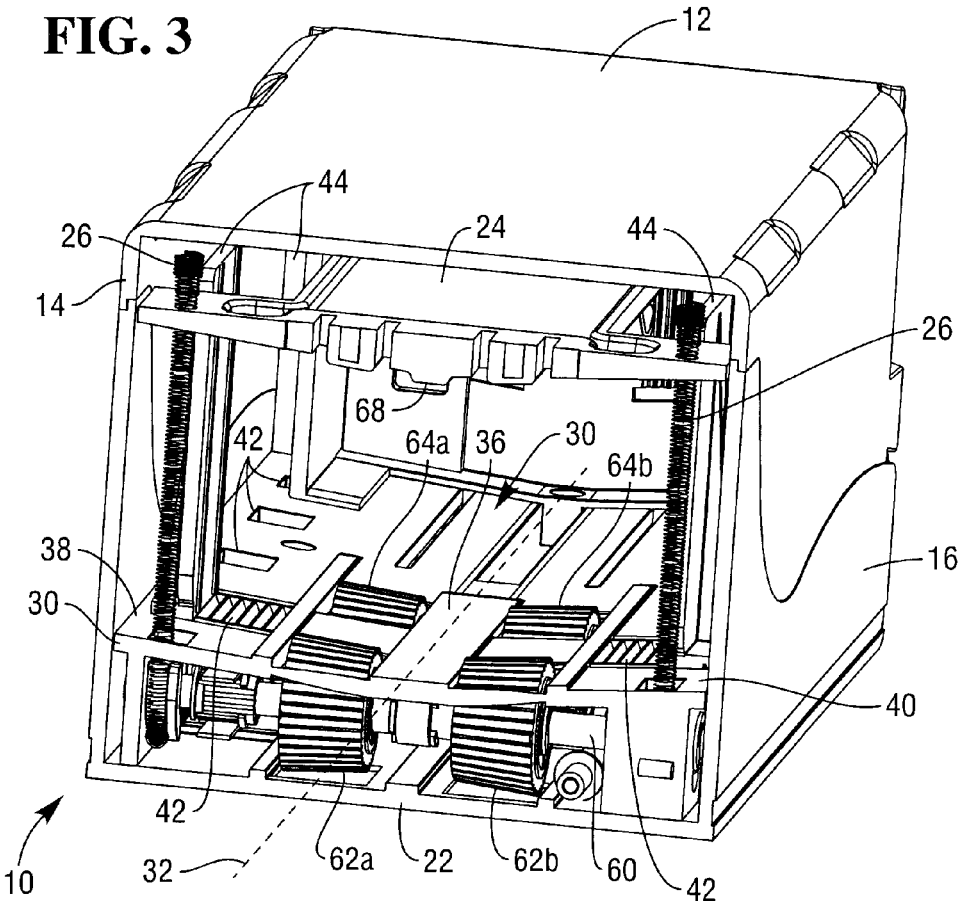
FIG. 3 is a perspective sectional view showing part (a base and drive rollers) of the media cassette of FIG. 1 in more detail.

Reference will now also be made to FIG. 3, which is a perspective sectional view showing part of the media cassette currency cassette 10 in more detail.

The currency cassette 10 further comprises a base 30 (or support platform), which is mounted at a lower part thereof resting on the floor 22. The base 30 defines a longitudinal axis (illustrated by broken line 32 in FIG. 3) extending centrally along the currency cassette 10.

The base 30 comprises a profiled surface 34 having a low region 36 at the longitudinal axis 32 and a pair of high regions 38,40 on opposing sides of the longitudinal axis 32.

The base 30 defines banknote width slots 42 into which upstanding banknote guides 44 can be inserted. These banknote guides 44 are provided so that the currency cassette 10 can be reconfigured for use with different currencies (since some currencies have wider banknotes than other currencies).

The base 30 also defines four apertures (best seen in FIG. 2): the first pair of apertures 54 are transverse to the longitudinal axis 32 and nearer to the pick end sidewall 20 than the second pair of apertures 56, which are parallel to the first pair of apertures 56.

The base 30 further comprises a drive axle 60 and an auxiliary axle 61 (best seen in FIG. 2) mounted in parallel relation transverse to the long edge sidewalls 14,16 and beneath the profiled surface 34. Each of these axles 60,61 has two drive rollers 62*a*,*b* and 64*a*,*b* mounted thereon. The four apertures 54,56 are configured to align with the four drive rollers 62,64 mounted beneath the profiled surface 34. The four drive rollers 62,64 protrude through the four apertures 54,56.

Figure 4:
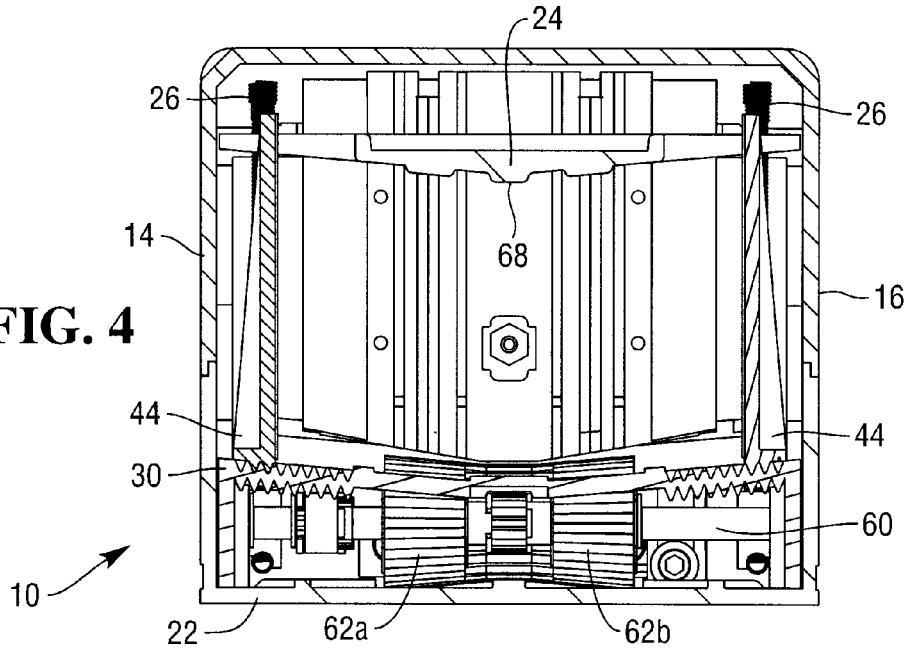
FIG. 4 is a simplified side view of the media cassette of FIG. 1, illustrating another part (a pusher plate) of the media cassette mounted above the cassette base and drive rollers of FIG. 3.

Reference is now also made to FIG. 4, which illustrates part of the pusher plate 24 mounted above the profiled surface 34.

The pusher plate 24 comprises a lower surface (the urging surface) 68 having a shape corresponding generally to the shape of the profiled surface 34 so that any banknotes located on the profiled surface 34 are deflected into a shape corresponding to the shape of the profile surface 34.

Figure 5:
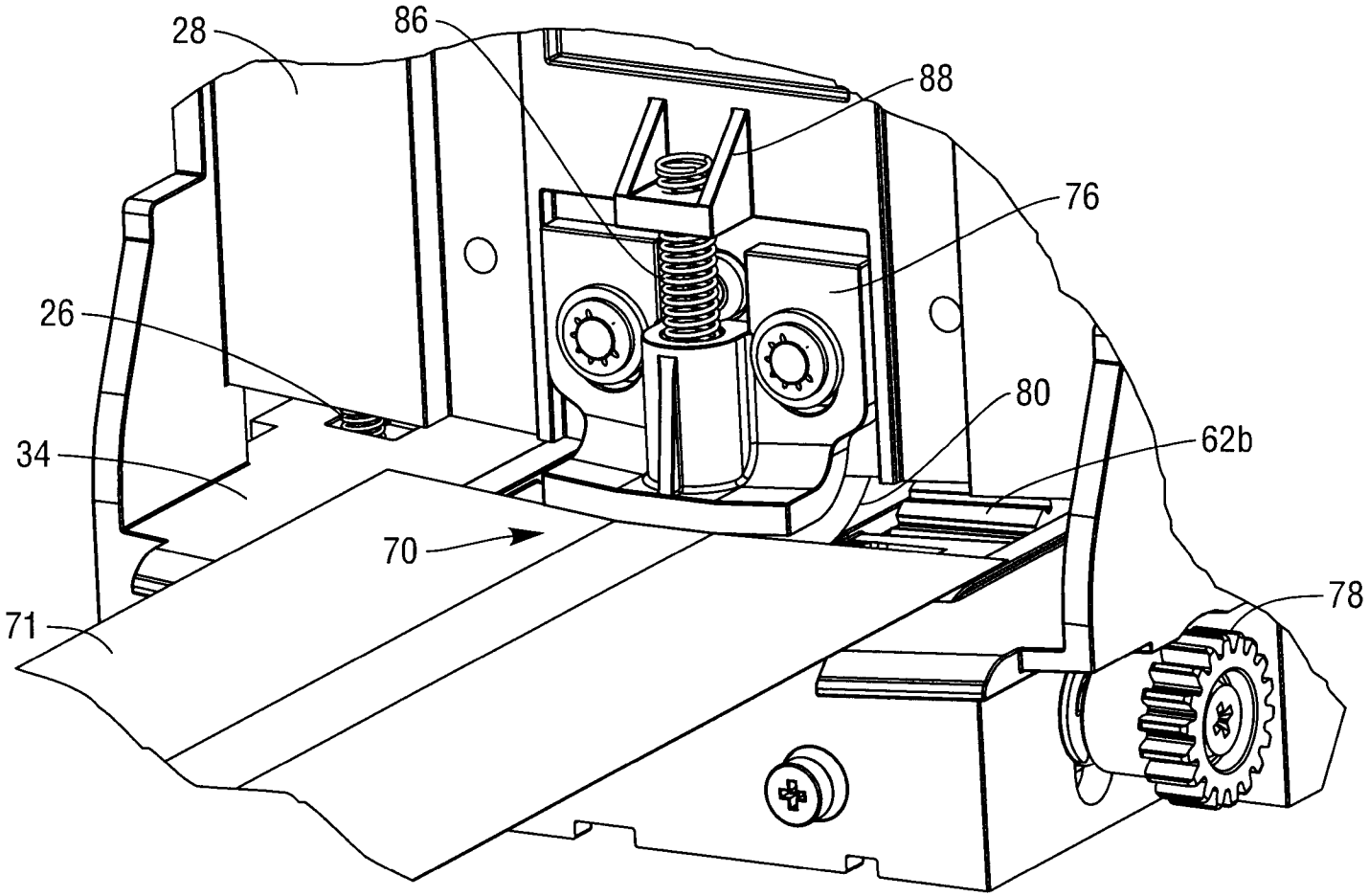
FIG. 5 is a simplified perspective view of a portion (a media withdrawing mechanism) of the media cassette of FIG. 1 during a media withdrawing operation.

Reference is now also made to FIG. 5, which is a simplified perspective view of a media withdrawing mechanism 70 (also shown in FIGS. 1 and 2) withdrawing a banknote 71.

The media withdrawing mechanism 70 comprises a feed roller 72 mounted on a feed axle 74 and a retard block 76 vertically offset from the feed roller 72 and mounted on the internal block mount wall 28. The feed roller 72 is centrally mounted relative to the longitudinal axis 32. In this embodiment, both the feed roller 72 and retard block 76 are made from elastomeric material.

The feed roller 72 defines a castellated outer circumference and has a central cylindrical portion, and extends away from the central cylindrical portion towards each long edge sidewall 14,16 with an increasing radius in each direction, thereby providing an outer surface that matches the shape of the profiled surface 34.

The feed axle 74 supports a transfer gear 78 that is used to impart rotational power to the feed roller 72, as will be described in more detail below.

The retard block 76 defines a lower surface 80 that matches the shape of the profiled surface 34. The lower surface 80 has a high coefficient of friction.

The retard block 76 is coupled to the internal block mount wall 28 via a bolt 82 mounted in a slot 84, and also via a resilient member 86 (in the form of a coil spring) coupled to a bracket 88. The coil spring 86 ensures that the retard block lower surface 80 is urged towards the feed roller 72 at all times. By using the coil spring 86, the need to calibrate the position of the retard block 76 accurately with respect to the feed roller 72 is avoided.

Figure 6:
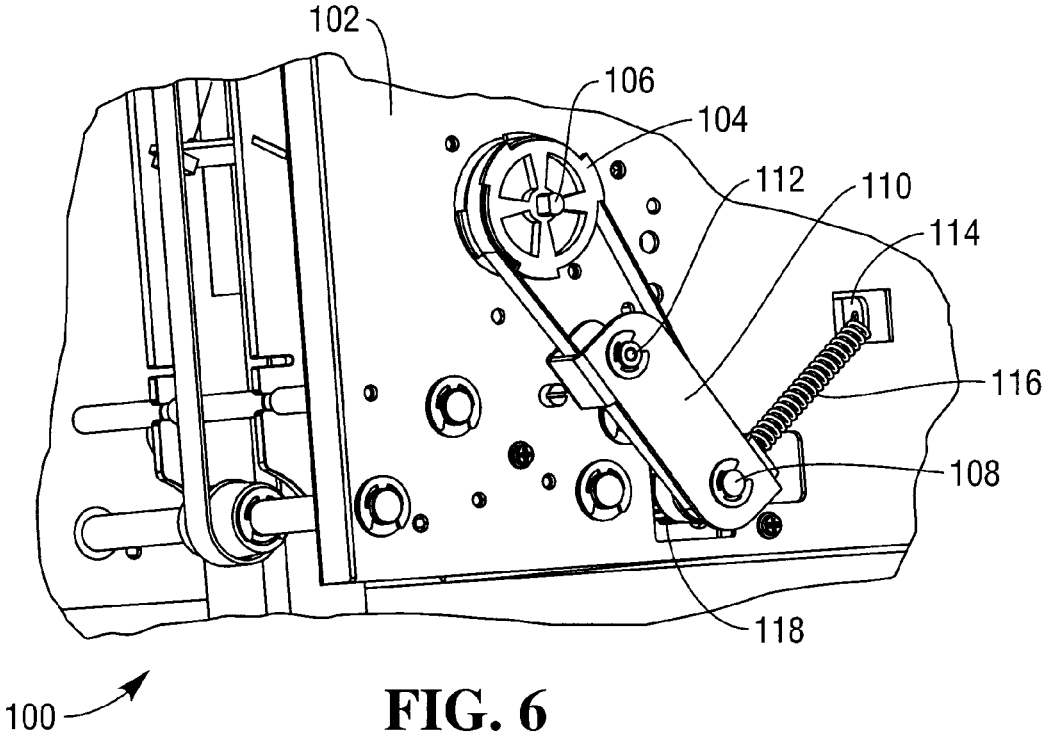
FIGS. 6 and 7 are perspective views of part (a cassette drive mechanism) of a media dispenser for use with the currency cassette of FIG. 1.
Figure 7:
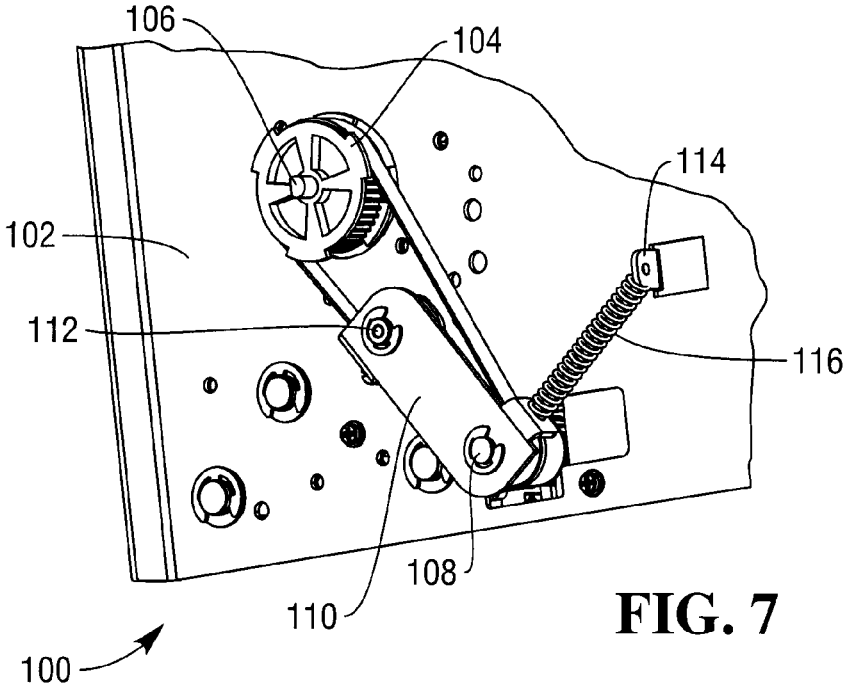

Reference will now be made to FIGS. 6 and 7, which are perspective views of part of a currency dispenser 100 for use with the currency cassette 10.

The currency dispenser 100 comprises a sidewall 102 on which is mounted a pulley 104 via a pulley shaft 106. The pulley 104 is coupled to a drive shaft 108. The drive shaft 108 supports a support bracket 110, which is pivotably coupled to a pivot shaft 112. The support bracket 110 is coupled to a lug 114 on the dispenser sidewall 102 by a resilient member 116 in the form of a coil spring. The drive shaft 108 is also coupled to a drive gear 118 (best seen in FIG. 6). The pivoting support bracket 110 enables the drive gear 118 to move as it is brought into contact with the transfer gear 78. This enables the drive gear 118 to mesh with the transfer gear 78 because the coil spring 116 urges the two gears 78,118 into, and maintains them in, intermeshing engagement.

To withdraw the banknote 71 from the currency cassette 10, the pulley 104 rotates, causing the transfer gear 78 to rotate. Rotation of the transfer gear 78 causes the drive and auxiliary axles 60,61 to rotate. This rotates the drive rollers 62,64, which urge the banknote 71 towards the feed roller 72 and the retard block 76.

The retard block 76 (specifically the retard block lower surface 80) serves to push back any banknote withdrawn simultaneously with the banknote 71. This prevents multi-picks (that is, multiple banknotes being picked as a single banknote). The retard block 76 ensures that if two banknotes 71 are transported as a single item, then the retard block lower surface 80 retards the upper banknote, so that only the lower banknote 71 is ejected from the currency cassette 10. This occurs because the friction between the upper banknote and the retard block lower surface 80 is higher than the friction between adjacent banknotes.

The shape of the base 30, the profiled surface 34, the pusher plate urging surface 68, the drive rollers 62,64, the feed roller 72, and the retard block lower surface 80 ensure that the banknote 71 is stored within the currency cassette 10, and transported out of the currency cassette 10, with a profiled shape (that is, in this embodiment the leading short edge has a curved shape). This greatly increases the structural rigidity of the banknote 71, so that limp banknotes can be reliably removed from the currency cassette 10.

Once inside the currency dispenser 100, the banknote 71 is transported in a conventional manner.

Figure 8:
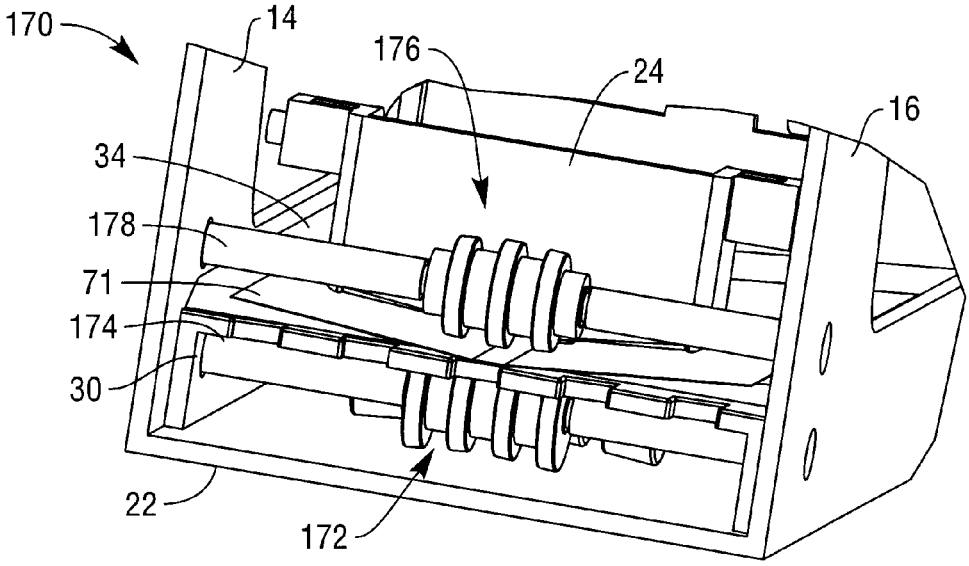
FIG. 8 is a simplified upper perspective view illustrating an alternative media withdrawing mechanism to the mechanism of FIG. 7.
Figure 9:
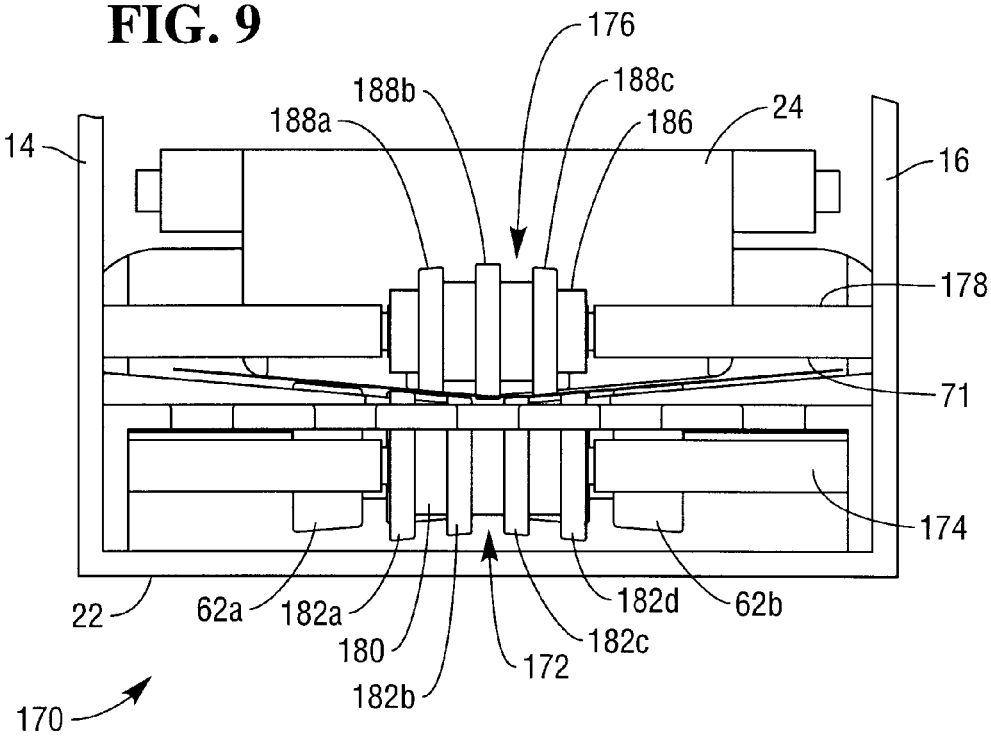
FIG. 9 is a simplified front view illustrating the alternative media withdrawing mechanism of FIG. 8.

Reference will now be made to FIGS. 8 and 9, which illustrate an alternative media withdrawing mechanism 170 according to another embodiment of the present invention.

The media withdrawing mechanism 170 comprises a feed roller 172 mounted on a feed axle 174 and a retard roller 176 vertically offset from the feed roller 172 and mounted on a retard axle 178. The feed roller 172 and retard roller 176 are centrally mounted relative to the longitudinal axis 32. In this embodiment, both the feed roller 172 and retard roller 176 are made from elastomeric material.

The feed roller 172 has an undulating outer profile that matches the shape of the profiled surface 34. The feed roller 172 defines a core 180 having a uniform radius and four discs 182*a,b,c,d* axially spaced along the core 180. The feed roller 172 is moulded as an integral unit. Each of the four discs 182 has a radius greater than the core 180, and the inner two discs 182*b,c* each has a radius slightly smaller than each of the outer two discs 182*a,d*. In fact, each disc 182 is not strictly a disc but has a frusto-conical shape, with a slightly smaller radius at an edge proximal to the longitudinal axis 32 than the radius of the edge distal from the longitudinal axis 32. This ensures that the four discs 182 combine to present a profile that matches the shape of the profiled surface 34.

The retard roller 176 also has an undulating outer profile that matches the shape of the profiled surface 34 and is complementary to the shape of the feed roller 172.

The retard roller 174 defines a core 186 having a uniform radius and three discs 188*a,b,c* axially spaced along the core 186 so that they are axially offset from the four feed roller discs 182. The central disc 188*b* has a larger radius than each of the two outer discs 188*a,c*. The retard roller 176 is moulded as an integral unit. In a similar way to the feed roller discs 182, the two outer retard roller discs 188*a,c* are actually frusto-conical in shape, but with a slightly larger radius at an edge proximal to the longitudinal axis 32 than the radius of the edge distal from the longitudinal axis 32.

When no banknote 71 is present between the feed roller 172 and the retard roller 176 then the feed roller discs 182 and the retard roller discs 188 interlace without touching each other as their cores 180,186 rotate. This results in less torque, and less wear to the parts, than if the feed roller and retard roller were in contact when no banknote is present.

When a banknote 71 is withdrawn from the profiled surface 34 by the feed roller 172, then the retard roller 176 (which is rotated in the same direction as the feed roller 172) serves to push back any banknote withdrawn simultaneously with the banknote 71. This prevents multi-picks (that is, multiple banknotes being picked as a single banknote).

Both of these embodiments (that is, both of the media withdrawing mechanisms 70,170) have the advantage that a media item (such as a banknote) has a profiled shape imparted to it both when it is stored and when it is withdrawn (or picked) from the media cassette. This reduces the effect of limpness on a banknote (or other media item) because the profiled shape of the banknote imparts structural rigidity to the banknote, thereby increasing the reliability of the picking operation.

Various modifications may be made to the above described embodiment within the scope of the invention, for example, in other embodiments, the media item may comprise a ticket, a voucher, a stamp, a pass, or the like.

In other embodiments, the retard block may comprise a different shape than that described in the first embodiment above.

In other embodiments the profiled surface 34 may define a different shape to that described above. For example, the profiled surface 34 may comprise a U-shape, a flattened U-shape, an undulating U-shape, a W-shape, or the like. The particular shape that is used is not critical, providing the shape that is selected imparts structural rigidity to the media item to be picked from the media cassette.

In other embodiments, more or fewer drive rollers may be used than those described above.

In this embodiment, the feed roller 172 and retard roller 176 may be made from polymeric material.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or required in instances where such broadening phrases are not used.

What is claimed is:

1. A media cassette comprising:

a base on which a stack of media items may be placed, the base including a non-flat, profiled surface extending from a central low region disposed along an axis of the base to higher regions on opposing sides of the central low region;

a pusher plate biased towards the base and operable to urge a stack of media items onto the non-flat, profiled surface;

a plurality of drive rollers located beneath the non-flat, profiled surface and partially protruding through apertures defined in the non-flat, profiled surface, the plurality of drive rollers being operable to drive a media item in contact with the non-flat, profiled surface out of the media cassette; and a media withdrawing mechanism including (i) a feed roller for withdrawing a media item from the base of the cassette, (ii) a retard block having a non-flat, profiled lower edge corresponding to the shape of the non-flat, profiled surface and extending along a direction which is transverse to direction of travel of a media item as the media item is being withdrawn from the base of the cassette, and (iii) the non-flat, profiled lower edge of the retard block being maintained in close proximity to the feed roller by a resilient member.

2. A media cassette according to claim 1, wherein the non-flat, profiled surface comprises a first surface extending from the central low region to one of the higher regions, and a second surface extending from the central low region to another of the higher regions.

3. A media cassette according to claim 1, wherein the non-flat, profiled surface comprises a curved surface extending from a first high region, down to the central low region, and then back up to a second high region opposite the first high region.

4. A media cassette according to claim 1, wherein the pusher plate includes an urging surface defining a non-flat profile corresponding to a shape of the non-flat, profiled surface, thereby urging media items into the shape of the non-flat, profiled surface.

5. A media cassette according to claim 1, wherein the plurality of drive rollers each defines a frusto-conical outer surface.

6. A media cassette according to claim 1, wherein the plurality of drive rollers are mounted on two axles, each axle located beneath the profiled surface and each axle being disposed transverse to the axis of the base.

7. A media cassette according to claim 6, wherein each axle includes a pair of drive rollers on each side of the axis of the base.

8. A media cassette according to claim 5, wherein a smaller diameter of each frusto-conical outer surface is located nearer the axis of the base than a larger diameter of that frusto-conical outer surface.

9. A media dispenser including the media cassette according to claim 1.

10. A method of dispensing a media item from a media cassette, the method comprising:

deforming the media item within the media cassette onto a non-flat, profiled surface using a pusher plate which is biased by one or more resilient members;

transporting the deformed media item using one or more drive rollers to a feed roller which has an undulating outer profiled surface that matches the shape of the non-flat, profiled surface; and urging the deformed media item out of the media cassette using the feed roller having the undulating outer profiled surface matching the non-flat, profiled surface of the deformed media item.

11. A media cassette comprising:

a base on which a stack of media items may be placed, the base including a non-flat, profiled surface extending from a central low region disposed along an axis of the base to higher regions on opposing sides of the central low region;

a pusher plate biased towards the base and operable to urge a stack of media items onto the non-flat, profiled surface;

a plurality of drive rollers located beneath the non-flat, profiled surface and partially protruding through apertures defined in the non-flat, profiled surface, the plurality of drive rollers being operable to drive a media item in contact with the non-flat, profiled surface out of the media cassette; and a media withdrawing mechanism including (i) a feed roller for withdrawing a media item from the base of the cassette, and (ii) a retard roller comprising an undulating outer surface, with the radially furthest out portions of the undulating surface conforming to the shape of the non-flat, profiled surface.

12. A media cassette according to claim 11, wherein the non-flat, profiled surface comprises a first surface extending from the central low region to one of the higher regions, and a second surface extending from the central low region to another of the higher regions.

13. A media cassette according to claim 11, wherein the non-flat, profiled surface comprises a curved surface extending from a first high region, down to the central low region, and then back up to a second high region opposite the first high region.

14. A media cassette according to claim 11, wherein the pusher plate includes an urging surface defining a non-flat profile corresponding to a shape of the non-flat, profiled surface, thereby urging media items into the shape of the non-flat, profiled surface.

15. A media cassette according to claim 11, wherein the plurality of drive rollers each defines a frusto-conical outer surface.

16. A media cassette according to claim 11, wherein the plurality of drive rollers are mounted on two axles, each axle located beneath the profiled surface and each axle being disposed transverse to the axis of the base.

17. A media cassette according to claim 16, wherein each axle includes a pair of drive rollers on each side of the axis of the base.

18. A media cassette according to claim 15, wherein a smaller diameter of each frusto-conical outer surface is located nearer the axis of the base than a larger diameter of that frusto-conical outer surface.

19. A media dispenser including the media cassette according to claim 11.

* * * * *